United States Patent [19]

Günther et al.

[11] Patent Number: 4,969,397

[45] Date of Patent: Nov. 13, 1990

[54] GRENADE-TYPE PROJECTILE

[75] Inventors: Michael Günther, Meerbusch; Jürgen Funk; Siegfried Quick, both of Düsseldorf; Hans Orth, Düsseldorf, all of Fed. Rep. of Germany

[73] Assignee: Rheinmetall GmbH, Düsseldorf, Fed. Rep. of Germany

[21] Appl. No.: 429,463

[22] Filed: Oct. 23, 1989

[30] Foreign Application Priority Data

Oct. 21, 1988 [DE] Fed. Rep. of Germany ..... 3835888

[51] Int. Cl.[5] ..... F42B 12/02; F42B 12/10; F42C 15/26

[52] U.S. Cl. ..... 102/233; 102/234; 102/235; 102/267; 102/476; 102/482; 102/488

[58] Field of Search ..... 102/701, 488, 476, 482, 102/483, 267, 268, 272, 273, 231–235, 244, 245, 251, 252

[56] References Cited

U.S. PATENT DOCUMENTS

| | | | |
|---|---|---|---|
| 1,545,139 | 7/1925 | Greenwell | 102/701 |
| 2,798,432 | 7/1957 | Meister | 102/272 |
| 3,771,451 | 11/1973 | Woodring | 102/482 |
| 3,995,557 | 12/1976 | Engel et al. | 102/267 |
| 4,128,061 | 12/1978 | Kaiser | 102/251 |
| 4,154,169 | 5/1979 | Petiteau | 102/233 |
| 4,419,934 | 12/1983 | Apotheloz | 102/233 |
| 4,449,455 | 5/1984 | Halssig | 102/234 |
| 4,464,991 | 8/1984 | Kaiser | 102/233 |
| 4,481,886 | 11/1984 | Brattström et al. | 102/476 |
| 4,494,459 | 1/1985 | Ziemba | 102/235 |

FOREIGN PATENT DOCUMENTS

| | | |
|---|---|---|
| 1907315 | 9/1972 | Fed. Rep. of Germany . |
| 3326683 | 2/1984 | Fed. Rep. of Germany . |
| 3441556 | 6/1985 | Fed. Rep. of Germany . |

*Primary Examiner*—David H. Brown
*Attorney, Agent, or Firm*—Spencer & Frank

[57] ABSTRACT

A grenade projectile has a projectile housing having a fragmentation length portion; an explosive charge accommodated in the projectile housing and being surrounded by the fragmentation length portion; a forwardly acting shaped charge liner bounding the explosive charge at a front end thereof, as viewed in the flight direction of the projectile; and a percussion fuse assembly accommodated in the projectile housing behind the explosive charge as viewed in the flight direction. The percussion fuse assembly includes a percussion member, a flight acceleration-responsive first safety arrangement and a centrifugal force-responsive second safety arrangement for arming the percussion member when the projectile reaches a predetermined acceleration and a predetermined spin.

18 Claims, 3 Drawing Sheets

FIG.1
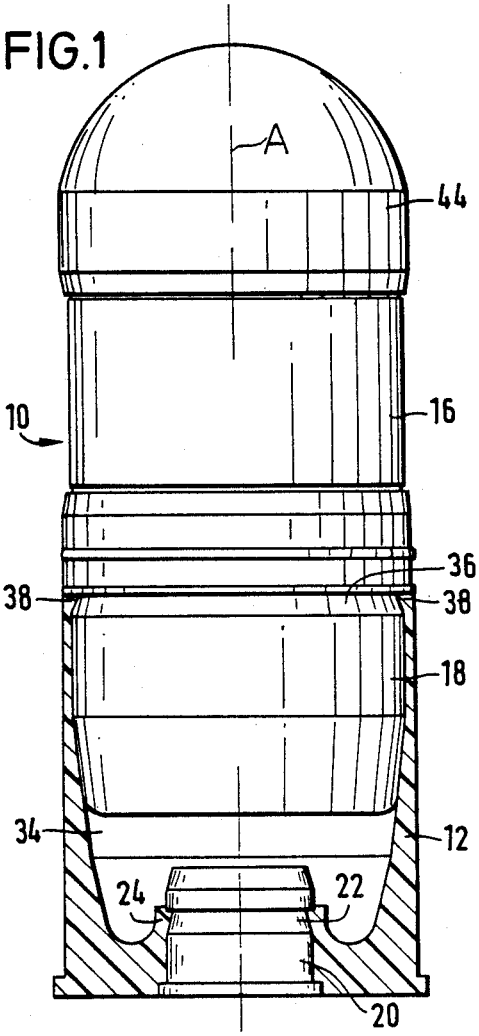
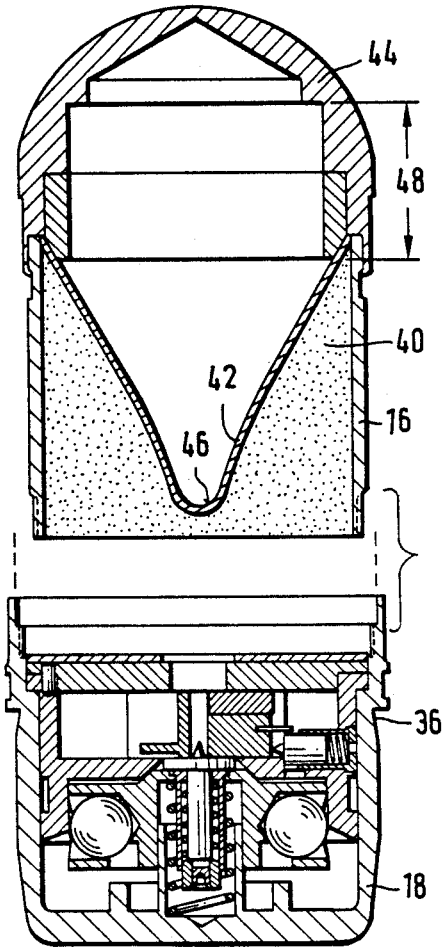
FIG.2
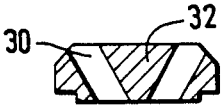
FIG.1b
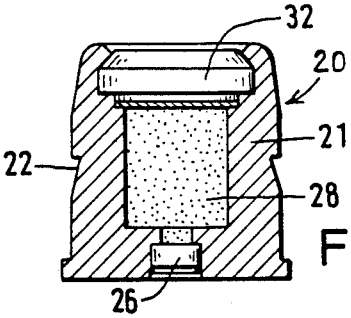
FIG.1a
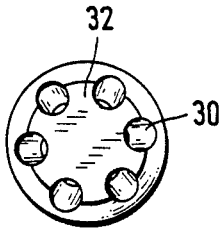
FIG.1c

GRENADE-TYPE PROJECTILE

BACKGROUND OF THE INVENTION

This invention relates to a full-caliber grenade-type projectile including an explosive charge and a percussion fuse and is designed to be fired from a portable weapon having a rifled barrel. The projectile includes a forward-acting shaped charge liner and a radially outwardly acting, fragment-forming, possibly pre-fragmented, projectile housing.

A high-explosive projectile (bomblet) having a shaped charge liner and a fragmentation housing is disclosed, for example, in German Auslegeschrift (examined published application) No. 1,907,315. In the projectile disclosed therein, however, the ignition device (fuse assembly) is arranged in a complicated telescoping configuration in front of the shaped charge liner (as viewed in the direction of flight) and must be penetrated by the shaped charge jet. Since the detonation waves form the shaped charge jet before they reach the front cap and cause it to burst away, the formation and effect of the shaped charge jet is impeded considerably. Moreover, the projectile, after having been ejected from a carrier projectile, is set to be active without special safety devices as soon as a frontal impact fuse finger is extended.

German Offenlegungsschriften (non-examined published applications) Nos. 3,326,683 and 3,441,556 each disclose a grenade-type projectile which includes an explosive charge and an impact fuse for firing from portable weapons having rifled barrels and which has a fragmentation effect to all sides but no forwardly directed shaped charge effect. Centrally within the projectile body, the grenade-type projectile is provided with a large-volume impact fuse which includes only a pyrotechnic muzzle area safety. Other, mutually independent safety devices are not provided.

SUMMARY OF THE INVENTION

It is an object of the present invention to provide an improved grenade-type projectile in which the above-described drawbacks are avoided, its range and target-active performance are improved and additional safety measures are included which require only little space and which ensure operational effectiveness even at relatively low rpm (starting from approximately 3000 rpm).

This object and others to become apparent as the specification progresses, are accomplished by the invention, according to which, briefly stated, the grenade projectile has a projectile housing having a fragmentation length portion; an explosive charge accommodated in the projectile housing and being surrounded by the fragmentation length portion; a forwardly acting shaped charge liner bounding the explosive charge at a front end thereof, as viewed in the flight direction of the projectile; and a percussion fuse assembly accommodated in the projectile housing behind the explosive charge as viewed in the flight direction. The percussion fuse assembly includes a percussion member, a flight acceleration-responsive first safety arrangement and a centrifugal force-responsive second safety arrangement for arming the percussion member when the projectile reaches a predetermined acceleration and a predetermined spin.

The invention is particularly designed and intended for a 40-mm grenade-type projectile to be fired individually from a portable weapon having a rifled barrel.

BRIEF DESCRIPTION OF THE DRAWING

FIG. 1 is an axial view of a 40-mm grenade-type projectile according to a preferred embodiment of the invention, showing a cartridge case in longitudinal section.

FIG. 1*a* is an axial sectional view of the propelling system of the cartridge case of FIG. 1.

FIG. 1*b* is an axial sectional view of a nozzle plate according to the invention serving as a frontal covering disk of the propelling system.

FIG. 1*c* is a top plan view of the nozzle plate shown in FIG. 1*b*.

FIG. 2 is an axial sectional view of the 40-mm grenade-type projectile of FIG. 1, showing the upper, payload portion and the lower, ignition and safety device in a disassembled state.

DESCRIPTION OF THE PREFERRED EMBODIMENT

Figure 3:
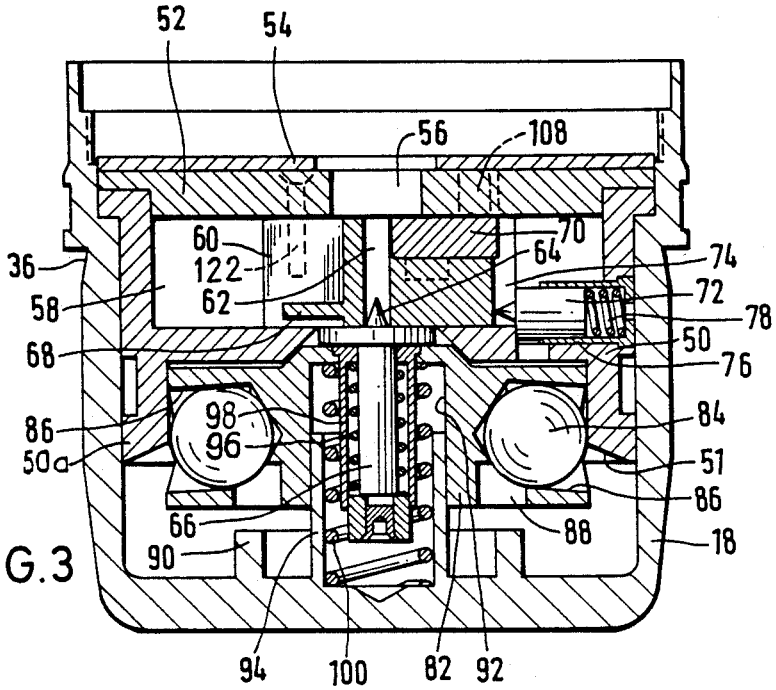
FIG. 3 is an enlarged axial sectional view of the ignition and safety device shown in FIG. 2.

FIG. 1 shows a grenade-type projectile 10 according to the invention, for example of a caliber of 40 mm, which is fastened in the front end of a plastic cartridge casing 12. The projectile/casing unit 10, 12 has a longitudinal axis A. The grenade-type projectile 10 is constructed of three parts: a specially configured frontal head cap 44, for example of aluminum, a cylindrical projectile wall (front housing) 16, for example, of pre-fragmented, rolled steel sheet forming a mid portion and a rear housing 18 which includes the ignition and safety device according to the invention.

In order to accelerate the grenade-type projectile 10, a propelling unit 20 is provided centrally in the base of cartridge case 12. The propelling unit 20 has a holder body 21 which, approximately in its middle region, has an external circumferential annular groove 22 into which engages a radially inwardly projecting annular bead 24 of the plastic cartridge case 12 for unreleasably immobilizing the propelling unit 20 in a simple manner by a snap-in connection.

FIGS. 1*a*, 1*b* and 1*c* show the internal structure of the propelling unit 20. Thus, the unit includes a primer 26 in the base of the holder body 21, propellant powder 28 contained in a central cavity of the holder body 21 and a nozzle plate 32 having gas passages 30. The nozzle plate 32 is immobilized in the front end of the holder body 21 and is oriented toward the interior of the cartridge case 12. For a better and more uniform introduction of the propellant gases into a gas pressure chamber 34 provided in the cartridge case 12, the gas passages 30, preferably six in number, are oriented obliquely forward and outward. By virtue of such an arrangement a more uniform pressure is able to build up and thus the grenade-type projectile 10 can attain a longer range. The simple and expedient connection between the grenade-type projectile 10 and the cartridge case 12 contributes to range increase. For causing a disconnection between the projectile 10 and the casing 12 a considerable gas pressure has to build up in the gas pressure chamber 34 before the projectile 10 is subsequently accelerated at a uniform, reproducible and increased initial velocity. The connection between the grenade-type projectile 10 and the cartridge case 12 is effected by providing in the wall of the housing 18—approximately at mid length of the projectile 10 —an external circumferential annular groove 36 into which projects, in a snap-in connection, a radially inwardly extending bead 38 of the plastic cartridge case 12. The connection is sufficiently firm to resist disengagement by manual force.

FIG. 2 shows the projectile 10 in longitudinal section. The pre-fragmented front housing 16 accommodates an explosive charge 40 and a shaped charge liner 42. To increase its effect on the target, the shaped charge liner 42 has a particular configuration: it has a trumpet shape such that, in the region of its central cone tip 46, the opening angle of the conical shaped charge liner 42 is relatively small and increases steadily in the forward direction. To ensure, on the one hand, a minimum stand-off for the shaped charge liner 42 from an armor plate target and, on the other hand, to securely support the shaped charge liner 42 and the explosive charge 40—even at the hardest impact on a target—the head cap 44 has, at least in its interior, a specially stepped shape. This cap configuration permits deformation of the head cap 44 to occur only in its frontal spherical portion so that the form-stable rear portion of the head cap 44, which is essentially cylindrical, always produces the minimum stand-off 48 for optimum jet formation from the liner 42.

The ignition and safety device according to the invention is accommodated in the rear housing 18 and will now be described and explained in detail.

Turning now to FIG. 3, the supporting element of the ignition and safety device is formed by a fuse housing 50 which is fixed in the rear housing 18 by means of a base plate 52 and a spacer disk 54. Both the base plate 52 and the spacer disk 54 are provided with a central bore in which a booster or transfer charge 56 is disposed to establish a firing connection between the detonator charge (primer) and the explosive charge 40 of the projectile. In a frontal space 58 of the fuse housing 50, a detonator carrier 60 is disposed which is pivotal transversely to the longitudinal axis of the projectile.

Figure 4:
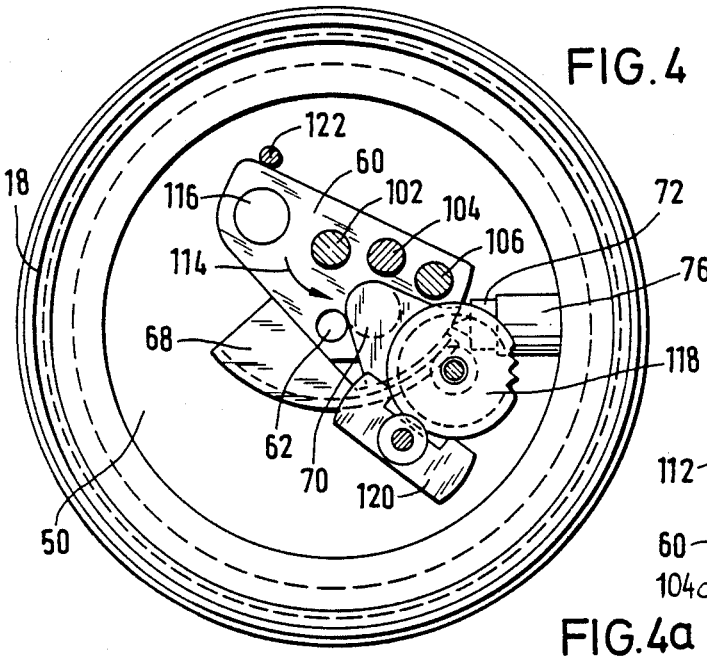
FIG. 4 is a top plan view of the ignition and safety device of FIG. 3 with some components removed for clarity.
Figure 4A:
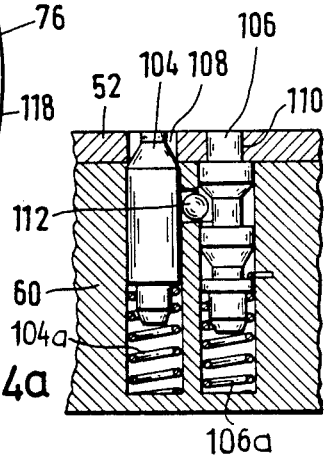
FIG. 4*a* is a sectional elevational view of a securing pin system in a pivotal detonator carrier according to the preferred embodiment.

Also referring to FIG. 4, the detonator carrier 60 is provided with a bore 62 in which, in the safety position, the tip 64 of a firing pin 66 is disposed. As part of a restraining safety mechanism, the detonator carrier includes a toothed wheel segment 68 and, in order to reduce structural height and increase the effect of centrifugal forces, an eccentric component 70 made, for example, of a heavy metal, such as lead or tungsten.

Radially adjacent the detonator carrier 60 (as related to the longitudinal projectile axis) there is provided a spin-dependent safety element formed of a spring-charged cylindrical blocking member 72 having a tip which extends behind a projection 74 of the detonator carrier 60 and immobilizes the latter. The blocking function of the member 72 is cancelled as it is displaced by centrifugal forces radially outwardly against the force of a spring 78. For this purpose, the blocking member 72 is displaceably mounted in a sleeve 76 which is fastened to the fuse housing 50 and which accommodates the compression spring 78.

Figure 5:
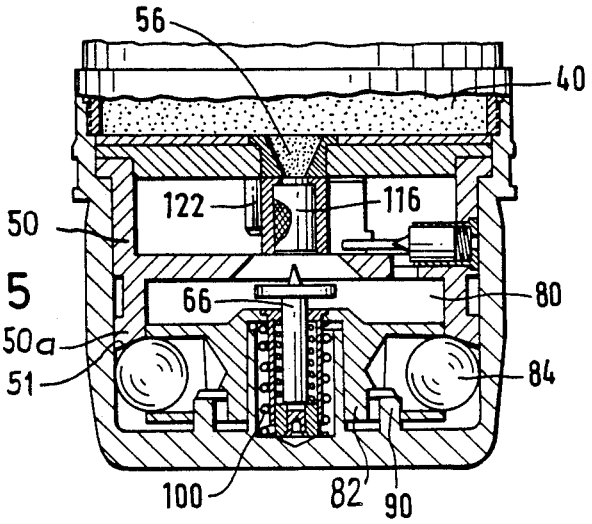
FIG. 5 is an axial sectional view of the ignition and safety device according to FIG. 3, depicted in the armed (live) position after firing.
Figure 6:
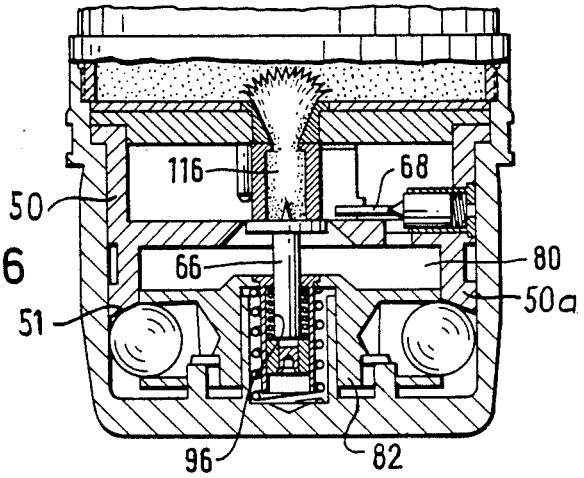
FIG. 6 is an axial sectional view showing the state of ignition upon impact on the target.

Also referring to FIGS. 5 and 6, the intermediate housing 50 is provided with a recess 80 in which a firing pin carrier 82 is axially displaceably mounted. The firing pin carrier 82 is provided with a sequentially acting, acceleration and spin-dependent locking element formed of a plurality of balls 84 which are preferably eight in number. The balls 84 are supported in radial blind bores 86 which are uniformly distributed along the circumference of the firing pin carrier 82. In the starting position (safety position), the balls 84 are held in their respective bores 86 by a lower cylindrical collar **50*a* of the intermediate housing 50**.

A concentric annular groove 88 is provided in the rearward circular face of the firing pin carrier 82 and communicates with radial bores 86 also provided in the firing pin carrier 82.

Precisely opposite the annular groove 88, at the interior base of the rear housing 18, there is disposed an annular projection 90 which extends into the annular groove 88 upon axial displacement of the firing pin carrier 82 and thus constitutes a reversal point as a positive guidance measure for the balls 84 in order to prevent them from rebounding. This positive control of the holding balls 84 ensures high operational reliability.

The firing pin carrier 82 includes a central bore 92 into which projects a cylindrical sleeve 94 that is fixed to the housing 18 and which serves as a guide for the firing pin carrier 82 during its axial displacement.

Centrally within the bore 92 a spring-supported firing pin 66 is mounted such that it is axially displaceable within a firing pin sleeve 98 against the force of a firing pin spring 96. The frontal face of the firing pin sleeve 98 is fastened in the firing pin carrier 82. By virtue of such a separate mounting of the firing pin a high firing sensitivity is achieved.

A further compression spring 100 is provided within the sleeve projection 94. The spring 100 closely surrounds the firing pin sleeve 98 and is supported at its rear by the inner face of the housing 18 and at its front engages the firing pin carrier 82 and urges the latter, when it is in the starting position, forward against the fuse housing 50.

FIG. 4 shows the eccentrically arranged pivotal detonator carrier 60 in its position of rest. The carrier 60 is mounted in the base plate 52 by a pivot pin 102. In the position of rest (starting position) the bore 62 is disposed in an accurate alignment with the longitudinal axis of the projectile in order to accommodate and secure at that location the firing pin tip 64. The eccentric component 70 is fastened (for example, plugged in), on one side of the detonator carrier 60. As shown in FIG. **4*a*, two acceleration-responsive recoil pins 104 and 106 are arranged in blind bores of the detonator carrier 60 adjacent the eccentric member 70 and project, with their upper pin heads, into respective bores 108, 110 in the base plate 52 and thus immobilize the detonator carrier 60 in the starting position. The pins 104 and 106 are urged into the respective bores 108 and 110 by respective springs 104*a*, 106*a***.

During acceleration upon firing, the pin 104 is initially urged downwardly against the force of the spring **104*a*. Thereafter, a blocking ball 112 is able to be displaced laterally in the direction of the pin 104 and no longer blocks the pin 110, so that the latter too, is able to be displaced downwardly by the acceleration forces, whereupon the lock between the detonator carrier 60 and the base plate 52** is released.

Under the effect of centrifugal forces due to spin, the blocking member 72, which acts as a spin-dependent safety element, no longer blocks the detonator carrier 60 so that the latter, due to the location of its center of gravity in the region of the eccentric component 70, seeks to pivot, together with detonator charge 116 arranged opposite the component 70, about the pin 102 in such a manner as to bring the detonator charge 116 into alignment with the longitudinal axis of the projectile, and thus into alignment with the firing pin 66. Such a pivoting movement, however, is braked by a restraining safety mechanism formed of the toothed wheel segment 68, a toothed wheel 118 meshing with the wheel segment 68 and fastened to the intermediate housing 50 and a swinging dual-lever escapement 120 which is also fastened to the intermediate housing 50 and is in engagement with the toothed wheel 118. The restraining safety mechanism functions similarly to a watch-escapement and thus reduces the speed of turning, rotating motion of the detonator carrier 60 to ensure that the detonator charge 116 is brought into alignment with the firing pin 66 only after the grenade-type projectile has left the gun barrel and the muzzle area.

In the starting, safety position, the detonator carrier 60 is supported at a stop pin 122 fastened to the base plate 52; in the armed position, after the detonator charge 116 has been pivoted and positioned underneath the firing pin tip 64, the detonator carrier 60 is supported, at another location of its rear wall, by the stop pin 122 and is securely immobilized in this position, for example by the engagement of a leaf spring behind a projection of the detonator carrier 60.

Figure 7:
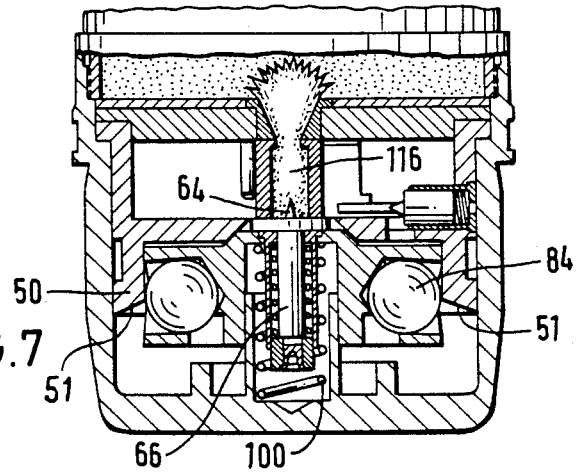
FIG. 7 is an axial sectional view of the state of ignition during self-destruction after the reduction of spin.

FIGS. 5, 6 and 7 depict the various functional states of the described firing mechanism. The projectile may be launched, for example, from a 40 mm grenade pistol.

With particular reference to FIG. 5, the acceleration at launch causes the firing pin carrier 82 to be displaced toward the projectile base, against the force of the compression spring 100. At the same time, the centrifugal force generated by the projectile spin causes the balls 84 to move out of the bores 86 to hold the firing pin carrier 82 firmly against a slope 51 at the rear edge of the intermediate housing 50 to support the carrier 82 in the active (armed) position. Further, since the annular projection 90 has entered into the groove 88 of the carrier 82, the balls 84 are caused to be positively guided outwardly over the edge of the engaging annular projection 90 and they are prevented from rebounding. This setting of the projectile into the active (armed) position must be completed before the projectile reaches the muzzle, otherwise the spring 100 pushes the firing pin carrier 82 forward again which would cause the fuse to remain inactive.

After release of the safety elements 104, 106, 112 and the blocking member 72, the detonator carrier 60 is pivoted and the detonator charge 116 assumes its position in alignment with the firing pin 66, the booster charge 56 and the explosive charge 40.

FIG. 6 shows the usual ignition upon hard impact on a target. The shock energy of the impact hurls the firing pin 66 forward against the force of the firing pin spring 96 into the detonator charge 116.

Turning now to FIG. 7, for the case where the target is missed or a soft impact occurs, for example, in snow or mud, the self-destruct device of the grenade-type projectile goes into action. The reduction of spin causes decay in the centrifugal forces. This, as will be described, results in the firing pin carrier 82, together with the firing pin 66, to be hurled forward by the force of the strong compression spring 100 and the firing pin tip 64 initiates firing of the detonator charge 116. This occurs after the spring force has pushed the holding balls 84 radially inwardly back along the sloped rear edge 51 of the intermediate housing 50 into their starting positions so that the firing pin carrier 82 is able to move rapidly forward from its rear, armed position.

The grenade-type projectile according to the invention is highly effective at the target due to a shaped charge jet that is not interfered with (because of its location behind the explosive charge) and due to an optimum fragmentation effect. The base fuse including two separate, independent safety elements and a self-destruct device has a space saving configuration and ensures complete functional effectiveness even at relatively low rpm's.

It will be understood that the above description of the present invention is susceptible to various modifications, changes and adaptations, and the same are intended to be comprehended within the meaning and range of equivalents of the appended claims.

What is claimed is:

1. A projectile-and-casing unit comprising (a) a grenade projectile having a longitudinal axis and including (1) a projectile housing having a fragmentation length portion and an outer circumferential groove approximately at mid length of the projectile housing;

(2) an explosive charge accommodated in said projectile housing and being surrounded by said fragmentation length portion;

(3) a forwardly acting shaped charge liner bounding said explosive charge at a front end thereof, as viewed in a flight direction of the projectile; and (4) a percussion fuse assembly accommodated in said projectile housing behind said explosive charge as viewed in said flight direction; said percussion fuse assembly including a percussion member, a flight acceleration-responsive first safety means and a centrifugal force-responsive second safety means for arming the percussion member when the projectile reaches a predetermined acceleration and a predetermined spin; and (b) a cartridge casing having, at a frontal end portion thereof, a radially inwardly extending circumferential rib projecting into said groove by a snap-in connection for firmly securing said projectile to said cartridge casing.

2. A projectile-and-casing unit comprising (a) a grenade projectile having a longitudinal axis and comprising (1) a projectile housing having a fragmentation length portion;

(2) an explosive charge accommodated in said projectile housing and being surrounded by said fragmentation length portion;

(3) a forwardly acting shaped charge liner bounding said explosive charge at a front end thereof, as viewed in a flight direction of the projectile; and (4) a percussion fuse assembly accommodated in said projectile housing behind said explosive charge as viewed in said flight direction; said percussion fuse assembly including a percussion member, a flight acceleration-responsive first safety means and a centrifugal force-responsive second safety means for arming the percussion member when the projectile reaches a predetermined acceleration and a predetermined spin;

(b) a cartridge casing having a rear base; and (c) a propelling unit disposed in said cartridge casing and being secured to said rear base; said propelling unit including (1) a holder body having a central cavity provided with an open front end;

(2) propellant powder disposed in said cavity; and (3) a closure plate closing off said open front end of said cavity and including means for defining a plurality of throughgoing passages oriented at an acute angle to said flight direction and being mutually divergent relative thereto.

3. A grenade projectile as defined in claim 2, wherein the number of said passages is six.

4. A grenade projectile as defined in claim 2, wherein said holder body has, approximately at mid length thereof, an external circumferential groove and said cartridge casing has, at said rear base, a radially inwardly extending circumferential rib projecting into said groove by a snap-in connection for firmly securing said propelling unit to the rear base of said cartridge casing.

5. A grenade projectile having a longitudinal axis and comprising (a) a projectile housing having a fragmentation length portion;

(b) an explosive charge accommodated in said projectile housing and being surrounded by said fragmentation length portion;

(c) a forwardly acting shaped charge liner bounding said explosive charge at a front end thereof, as viewed in a flight direction of the projectile; and (d) a percussion fuse assembly accommodated in said projectile housing behind said explosive charge as viewed in said flight direction; said percussion fuse assembly including (1) a percussion member, (2) a flight acceleration-responsive first safety means;

(3) a centrifugal force-responsive second safety means for arming the percussion member when the projectile reaches a predetermined acceleration and a predetermined spin;

(4) a detonator carrier;

(5) a detonator secured to said detonator carrier;

(6) eccentric pivot means having a pivot axis being parallel to and spaced from said longitudinal axis and supporting said detonator carrier for swinging motions thereof in response to centrifugal forces derived from the projectile spin;

(7) an acceleration-responsive device forming part of said first safety means and being arranged for preventing swinging motions of said detonator carrier until the predetermined flight acceleration is reached;

(8) a centrifugal force-responsive device forming part of said second safety means and being arranged for preventing swinging motions of said detonator carrier until the predetermined spin is reached;

(9) a firing pin holder supported for axial displacement; and

(10) a firing pin, constituting said percussion member, supported in said firing pin holder for axial displacement relative thereto; said detonator assuming an aligned position relative to said firing pin when said detonator carrier has swung in response to centrifugal forces derived from the spin of the projectile.

6. A grenade projectile as defined in claim 5, wherein said percussion fuse assembly includes a fuse housing supporting said eccentric pivot means and further wherein said acceleration-responsive device includes (a) first and second side-by-side disposed recoil pins held in said detonator carrier for longitudinal sliding motions in a direction parallel to the longitudinal projectile axis;

(b) spring means for urging said recoil pins into respective openings provided in said fuse housing for preventing a swinging motion of said detonator carrier;

(c) a locking ball for preventing the sliding motion of said second recoil pin; said locking ball being disposed in said detonator carrier between said two recoil pins and being displaceable in a direction transverse to the projectile axis; and (d) means provided on the first recoil pin for blocking a displacement of the locking ball for preventing the sliding motion of the second recoil pin as long as the first recoil pin projects into the respective opening in the fuse housing and for allowing the longitudinal sliding motion of the second recoil pin by acceleration forces when said first recoil pin has been displaced by acceleration forces.

7. A grenade projectile as defined in claim 5, wherein said percussion fuse assembly includes a fuse housing supporting said eccentric pivot means, and further wherein said centrifugal force-responsive device includes a locking member held in said fuse holding for sliding motion in a radial direction relative to said longitudinal projectile axis and spring means for exerting a force on said locking member; said locking member having a first position into which it is urged by the spring means and in which it prevents turning, rotating motions of said detonator carrier; said locking member having a second position into which it is urged, against said spring means, by centrifugal forces derived from projectile spin and in which it allows swinging motions of said detonator carrier.

8. A grenade projectile as defined in claim 5, further comprising a weight of heavy metal mounted on said detonator carrier at a location spaced from said pivot axis and from said longitudinal axis.

9. A grenade projectile as defined in claim 5, wherein said acceleration-responsive device is a first acceleration-responsive device; further comprising a second acceleration-responsive device forming part of said first safety means and being arranged for blocking swinging motions of said detonator carrier until a predetermined flight-acceleration is reached.

10. A grenade projectile as defined in claim 9, wherein said second acceleration-responsive device includes spring means for axially urging said firing pin carrier and said firing pin as a unit in the flight direction, and an aperture in said detonator carrier in alignment with said firing pin; said firing pin carrier has an advanced position in which said firing pin projects into said aperture and blocks the detonator carrier from executing swinging motions; said firing pin carrier has a withdrawn position in which said firing pin is clear of said aperture; said firing pin carrier assuming said withdrawn position after overcoming the force of said spring means in response to forces derived from flight acceleration.

11. A grenade projectile as defined in claim 5, wherein said percussion fuse assembly includes a fuse housing and a restraining safety means supported by said fuse housing and connected to said detonator carrier for braking turning, rotating motions of said detonator carrier.

12. A grenade projectile as defined in claim 11, wherein said restraining safety means includes (a) a first toothed gear affixed to said detonator carrier;

(b) a second toothed gear rotatably mounted on said fuse housing and meshing with said first gear; and (c) an escapement oscillatingly mounted on said fuse housing and being connected to said second toothed gear for braking rotary motions thereof.

13. A grenade projectile having a longitudinal axis and comprising (a) a projectile housing having a fragmentation length portion;

(b) an explosive charge accommodated in said projectile housing and being surrounded by said fragmentation length portion;

(c) a forwardly acting shaped charge liner bounding said explosive charge at a front end thereof, as viewed in a flight direction of the projectile; and (d) a percussion fuse assembly accommodated in said projectile housing behind said explosive charge as viewed in said flight direction; said percussion fuse assembly including (1) a percussion member;

(2) a flight acceleration-responsive first safety means;

(3) a centrifugal force-responsive second safety means for arming the percussion member when the projectile reaches a predetermined acceleration and a predetermined spin;

(4) a fuse holding held in said projectile housing;

(5) a carrier supporting said percussion member and being held in said fuse holding for sliding motions parallel to said longitudinal axis;

(6) a spring means urging said carrier in said flight direction into an abutting relationship with said fuse housing; and (7) retaining means for preventing said carrier from moving in response to said spring means after said carrier has moved into a withdrawn position against the force of said spring means in a direction opposite said flight direction in response to acceleration forces.

14. A grenade projectile as defined in claim 13, further comprising spin decay-responsive self-destructing means for igniting said explosive charge when the spin has slowed to a predetermined value.

15. A grenade projectile as defined in claim 13, wherein said retaining means includes (a) radially oriented channels provided in said carrier; each channel having a radially outwardly oriented open end;

(b) a separate locking ball received in each said channel for radially outward motion in response to centrifugal forces derived from projectile spin; and (c) detent means formed on said fuse housing for engaging said locking balls when projecting through the respective radially outwardly oriented open ends and when said carrier has moved into said withdrawn position.

16. A grenade projectile as defined in claim 15, wherein said detent means have an oblique engagement face for causing, by a camming action, said locking balls to move radially inwardly clear of the detent means when said spring means has overcome decaying centrifugal forces acting on said locking balls to allow said spring means to launch said carrier, together with said percussion member, in said flight direction for detonating said explosive charge when projectile spin is reduced.

17. A grenade projectile as defined in claim 15, wherein said retaining means further comprises (d) an annular projection affixed to an internal wall of said projectile housing and being disposed in axial alignment with the longitudinal projectile axis;

(e) an annular groove formed in said carrier in alignment with said annular projection, said annular groove being in communication with each said radially oriented channel; said annular projection extending through said annular groove and into each said radially oriented channel when said carrier is in said withdrawn position.

18. A grenade projectile as defined in claim 17, wherein said percussion member is a firing pin; said percussion fuse assembly further comprising support means for holding said firing pin in said carrier for sliding movements relative to said carrier and in a direction parallel to said longitudinal projectile axis; and an additional spring means supported in said carrier and engaging said firing pin for urging said firing pin in a direction opposite said flight direction; said firing pin being arranged to be movable in said flight direction relative to said carrier by deceleration forces generated upon impact of the projectile.

* * * * *